US006729574B2

(12) United States Patent
Henry et al.

(10) Patent No.: US 6,729,574 B2
(45) Date of Patent: May 4, 2004

(54) GRIPPING DEVICE FOR PACKAGE, IN PARTICULAR FOR YARN WINDING MACHINES

(75) Inventors: Pierre Henry, Pfastatt (FR); Michel Mazoyer, Pfastatt (FR)

(73) Assignee: Superba, Mulhouse (FR)

( * ) Notice: Subject to any disclaimer, the term of this patent is extended or adjusted under 35 U.S.C. 154(b) by 0 days.

(21) Appl. No.: 10/243,752

(22) Filed: Sep. 16, 2002

(65) Prior Publication Data

US 2003/0052219 A1 Mar. 20, 2003

Related U.S. Application Data

(60) Provisional application No. 60/324,099, filed on Sep. 24, 2001.

(30) Foreign Application Priority Data

Sep. 17, 2001 (FR) ..... 01 12012

(51) Int. Cl.[7] ..... B65H 16/06

(52) U.S. Cl. ..... 242/596.3; 242/596.5; 242/129.51

(58) Field of Search ..... 242/596.1, 596.3, 242/596.5, 131, 129.51, 486.2, 473.9

(56) References Cited

U.S. PATENT DOCUMENTS

| | | | | | |
|---|---|---|---|---|---|
| 2,212,776 | A | * | 8/1940 | Hamel | 242/486.2 |
| 2,776,098 | A | * | 1/1957 | Baumann et al. | 242/129.51 |
| 3,034,738 | A | * | 5/1962 | Kuhn | 242/596.3 |
| 3,940,074 | A | * | 2/1976 | Laski et al. | 242/486.2 |
| 4,013,242 | A | * | 3/1977 | Burysek et al. | 242/129.51 |
| 4,049,140 | A | * | 9/1977 | Roose | 242/596.3 |
| 4,062,503 | A | | 12/1977 | Chaplin, Jr. et al. | |
| 5,018,677 | A | * | 5/1991 | Fahmuller | 242/486.2 |
| 5,025,998 | A | * | 6/1991 | Hutzenlaub et al. | 242/596.1 |
| 5,033,686 | A | | 7/1991 | Rebsamen | |
| 5,060,878 | A | * | 10/1991 | Hutzenlaub et al. | 242/129.51 |
| 5,988,555 | A | * | 11/1999 | Unruh et al. | 242/596.3 |
| 6,098,919 | A | * | 8/2000 | Lewis | 242/596.3 |

FOREIGN PATENT DOCUMENTS

| | | |
|---|---|---|
| DE | 41 25 310 A1 | 2/1992 |
| DE | 199 21 630 A1 | 11/2000 |
| FR | 2 098 134 | 3/1972 |
| FR | 2 202 511 | 5/1974 |
| GB | 2 137 669 A | 10/1984 |

* cited by examiner

*Primary Examiner*—John Q. Nguyen
(74) *Attorney, Agent, or Firm*—Young & Thompson

(57) ABSTRACT

Device for gripping a package, in particular for yarn winding machines, is constituted by two lateral arms each provided at its free end with a spindle for mounting a tube of a package, movably mounted by their other end on a slide way for support and mounting on a winding machine and actuated to open and close by a jack, the mounting of each lateral arm on the slide way for support and mounting on the winding machine being carried out by an axle secured to the slide way and coacting with an oblong hole in the lateral arm. The slide way is moreover provided with abutments for guiding and limiting the path, which coact with the corresponding end of the lateral arms during opening and closing of the lateral arms.

15 Claims, 2 Drawing Sheets

GRIPPING DEVICE FOR PACKAGE, IN PARTICULAR FOR YARN WINDING MACHINES

FIELD OF THE INVENTION

The present invention relates to the field of the textile industry, in particular machines for winding yarns and has for its object a gripping device for a package for such machines.

BACKGROUND OF THE INVENTION

At present, there exists a device for gripping the tubes of packages which is in the form of an assembly of jacks and springs acting symmetrically on two gripping arms for the tube, these arms being movably mounted rotatably about a hinge point. In this device, the gripping of the tube is carried out by means of two mandrels.

Such a gripping device has the drawback of requiring preliminary adjustment of the spacing of the axes of rotation of the arms as a function of the length of the tube to be gripped between said arms, so as to avoid damaging said tube by a chewing action and to release the yarn which is gripped between said mandrels in an incorrect manner. Moreover, there also exists the risk of decreasing the duration of life of the roller bearings of the mandrels.

There is also known a gripping device comprising a fixed arm, which is however adjustable in position, and an arm articulated in rotation which bears against the free end of the tube by means of a mandrel.

Such a gripping device however has the drawback of requiring adjustment of the positioning of the fixed arm to permit centering of the tube at the winding station. Moreover, in this embodiment, the surface of the mandrel is pressed inaccurately parallel on the tube, which gives rise to the same problems of damaging the tube, releasing the yarn and lifetime of the roller bearings of the mandrel.

SUMMARY OF THE INVENTION

The present invention has for its object to overcome these drawbacks by providing a gripping device for a package in particular for yarn winding machines permitting simple and rapid adaptation to all types of tubes and packages to be produced.

To this end, the gripping device for a package according to the invention is characterized in that it is constituted by two lateral arms each provided at its free end with a spindle for mounting a package tube, movably mounted by their other end on a slide way for supporting and mounting on a winding machine and actuated to open and close by means of a jack, the mounting of each lateral arm on the support and mounting slide way of the winding machine being carried out by means of an axle secured to the support and mounting slide way on the winding machine and coacting with an oblong hole of the lateral arm, said support and mounting slide way on the winding machine being provided moreover with guide abutments for limiting the path, coacting with the corresponding end of the lateral arms during the opening and closing of said lateral arms.

BRIEF DESCRIPTION OF THE DRAWINGS

The invention will be better understood from the following description, which relates to a preferred embodiment, given by way of non-limiting example, and explained with reference to the accompanying schematic drawings, in which.

DETAILED DESCRIPTION OF THE INVENTION

Figure 1:
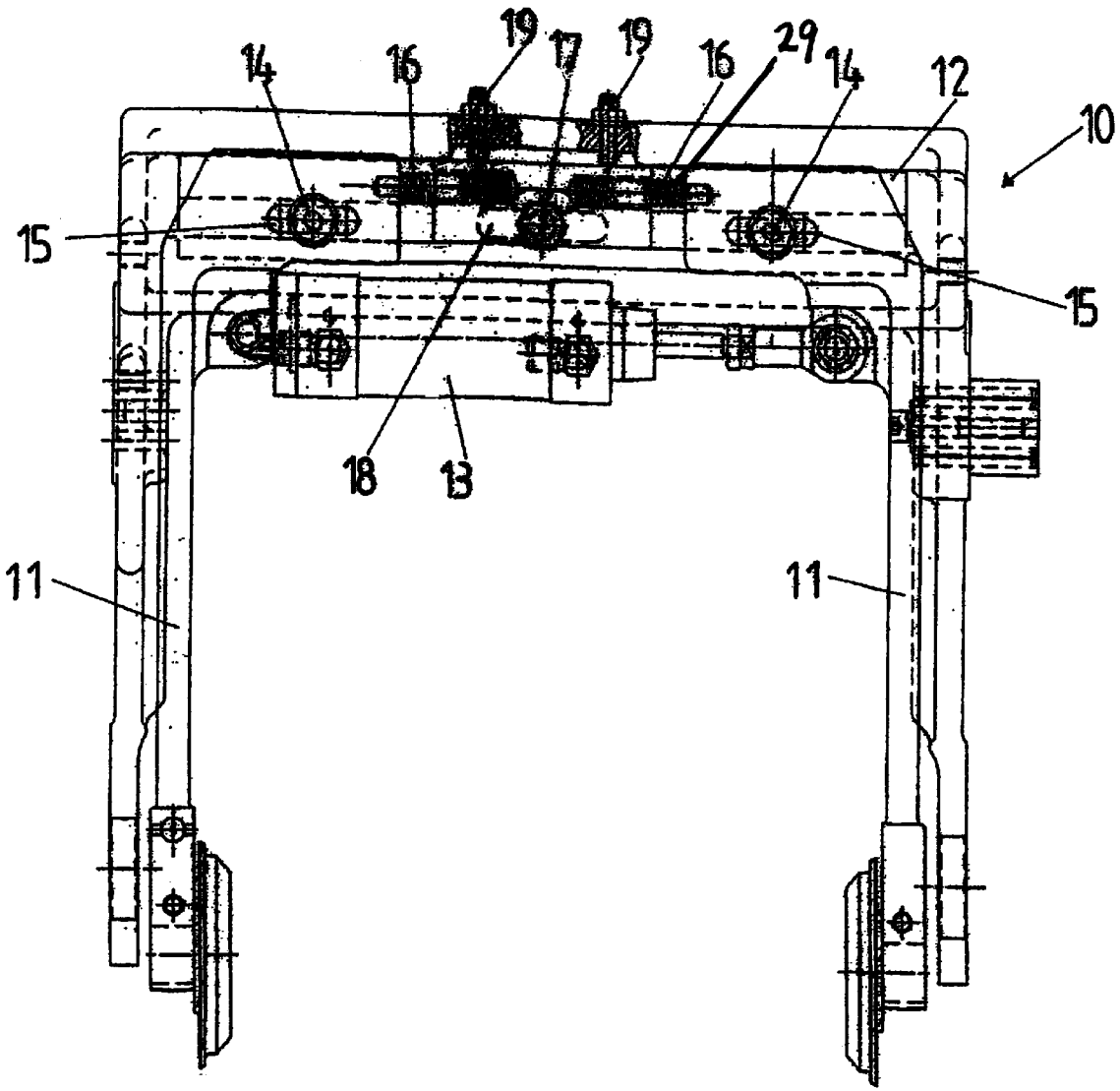
FIGS. 1 and 2 are front elevational views of a package gripping device, in respective positions of cylindrical winding and conical winding.
Figure 2:
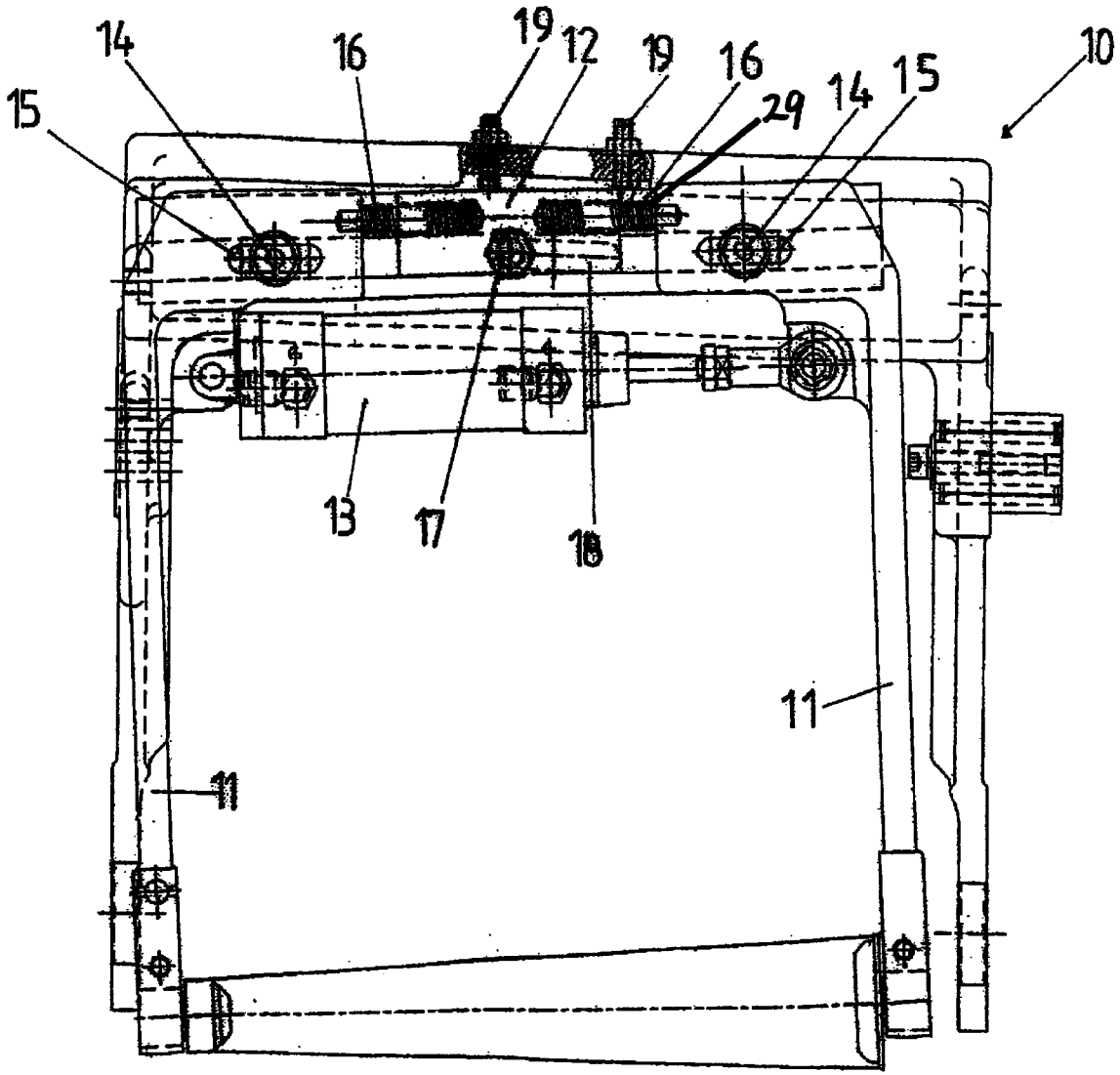

As shown in FIGS. 1 and 2 of the accompanying drawings, the packages are each mounted on a gripping device 10 controlled by the mechanical device.

According to one characteristic of the invention, such a gripping device 10 is preferably constituted by two lateral arms 11 each provided at its free end with a mounting spindle for a package mandrel, movably mounted by their other end on a slide way support and mounting arm 12 on the winding machine and actuated to open and close by means of a jack 13.

The mounting of each lateral arm on the slide way support and mounting arm 12 on the winding machine is carried out by means of an axle 14 secured to the arm 12 and coacting with an oblong hole 15 in the arm 11, said arm 12 being provided moreover with abutments 16 for guiding and limiting the path, coacting with the corresponding end of the arms 11 during opening and closing of said arms 11. Such abutments 16 for guiding and limiting the path can be constituted in the form of spindles secured to the arm 12 and penetrating with their free end into corresponding recesses in the arms 11, a return spring 29 mounted on each spindle, or a traction spring acting on each arm 11, tending to return said arms 11 toward their open position and carrying out an automatic centering by balancing the loads exerted on the arms 11.

The jack 13 is mounted by its cap on one of the arms 11 and by its piston rod on the other arm 11. Thus, an actuation of the jack 13 will have the effect of erratic operation, which is corrected by the action of the springs 29 of the abutments 16 tending automatically to center the arms 11 relative to the support arms 12.

According to another characteristic of the invention, the arm 12 for support and mounting on the winding machine is preferably mounted on said winding machine by means of an axle 17 coacting with an oblong hole 18 in said arm 12, adjustable abutments 19 also being provided on the winding machine acting on said arm 12 on its side opposite that turned toward the package, so as to block said arm in its service position. Thus, as shown in FIG. 1 of the accompanying drawings, the arm 12 can be moved and inclined relative to the winding machine for assembling a conical package, so as to bring one of the generatrices of this package into a plane parallel to the generatrix of the drive shaft of the corresponding package. To this end, the arm 12 carrying the arm 11 is first moved relative to the winding machine and then inclined at an angle corresponding to the half angle of conicity and is blocked in this position by gripping, on the one hand, of the axle 17 cooperating with the oblong hole 18, and on the other hand, of the abutments 19 bearing on said arm 12. The bearing of the abutments 19 on the arm 12 effects the blockage in inclined position of the arm 12 and hence of the arms 11 of the gripping device 10.

Of course, for using conical packages, the spindles for receiving the ends of the package mandrel are removable and interchangeable pieces mounted in the free ends of the arms 11.

Thanks to the invention, it is possible to provide a device for gripping packages, in particular for yarn winding machines, that can be easily adjusted for its adaptation to all types of packages to be formed.

Of course, the invention is not limited to the embodiment described and shown in the accompanying drawings. Modifications remain possible, particularly as to the construction of the various elements or by substitution of technical equivalents, without thereby departing from the scope of the protection of the invention.

What is claimed is:

1. Device for gripping a package, comprising:

two lateral arms each provided at a free end with a spindle for mounting a tube of a package, the two lateral arms movably mounted by their other end on a slide way support mounting on a winding machine and actuated to open and close by means of a jack, the mounting of each lateral arm on the slide way support being carried out by an axle secured to the slide way support and coacting with an oblong hole in each lateral arm, said slide way support being moreover provided with abutments for guiding and limiting a path of movement of the arms, coacting with the corresponding end of the lateral arms during opening and closing of said lateral arms.

2. Gripping device, according to claim 1, characterized in that the abutments for guiding and limiting the path are constituted by spindles secured to the slide way support and penetrating with their free ends into corresponding recesses in the lateral arms, a return spring mounted on each spindle, or a tension spring acting on each lateral arm, tending to return said lateral arms toward their open or closed position and effecting an automatic centering by balancing the loads exerted on the lateral arms.

3. Gripping device, according to claim 1, characterized in that, the jack comprises a cylinder and a piston rod, and the jack is mounted by said cylinder on one of the lateral arms and by said piston rod on the other lateral arm.

4. Gripping device, according to claim 1, characterized in that the slide way support is mounted on said winding machine by an axle cooperating with an oblong hole in the support chassis of said slide way support, adjustable abutments being also provided on the winding machine acting on said slide way support on a side opposite that turned toward the package, so as to hold a corresponding lateral arm in a specific position.

5. The gripping device of claim 1, wherein the device is operable with a yarn winding machine.

6. The gripping device of claim 1, characterized in that the abutments for guiding and limiting the path are constituted by spindles secured to the slide way support and penetrating with their free ends into corresponding recesses in the lateral arms, said lateral arms tending to return toward their open or closed position effecting an automatic centering by balancing the loads exerted on the lateral arms.

7. The gripping device of claim 1, characterized in that the slide way support is mounted by an axle on said winding machine, said axle cooperating with an oblong hole in the support chassis of said slide way support, adjustable abutments being also provided on the winding machine acting on said slide way support so as to hold a corresponding lateral arm in a specific position.

8. A gripping device for gripping a package, comprising:

two lateral arms;

a spindle provided at a free end of each of the two lateral arms, the spindles for mounting a tube;

a slide way mount for each of the two lateral arms, each of the slide way mounts movably mounting a corresponding one of the lateral arms, each of the slide way mounts comprising abutments for guiding and limiting movement of the corresponding lateral arms relative to the slide way mount; and a jack actuating, via axles secured to the slide way mounts, to open and close each of the two lateral arms, the axle co-acting with an oblong hole in each of the lateral arms.

9. A gripping device for gripping a package, comprising:

two lateral arms;

a spindle, for mounting a tube of a package, provided at a first free end of each of the two lateral arms;

a support movably mounting each of the two lateral arms on a winding machine, the support provided on a second end of each lateral arm;

a jack actuated to open and close the lateral arms via an axle secured to each support and co-acting with an oblong hole in each lateral arm; and abutments provided with the support for guiding and limiting a path of movement of each of the lateral arms relative to the support during opening and closing of said lateral arms.

10. Gripping device of claim 9, wherein the abutments comprise spindles secured to the support and penetrating with their free ends into corresponding recesses in the lateral arms, said lateral arms tending to move toward their open and closed position effecting an automatic centering by balancing the loads exerted on the lateral arms.

11. Gripping device of claim 9, wherein, the jack comprises a cylinder and a piston rod, and the jack is mounted by said cylinder on one of the lateral arms and by said piston rod on the other lateral arm.

12. Gripping device of claim 9, wherein the support is mounted on said winding machine by an axle cooperating with an oblong hole in a support chassis of said support, adjustable abutments being also provided on the winding machine acting on said support on a side opposite that turned toward the package, so as to hold a corresponding lateral arm in a specific position.

13. The gripping device of claim 9, wherein the device is operable with a yarn winding machine.

14. The gripping device of claim 9, wherein the abutments for guiding and limiting the path comprise spindles secured to the support and penetrating with their free ends into corresponding recesses in the lateral arms, said lateral arms tending to return toward their open or closed position effecting an automatic centering by balancing the loads exerted on the lateral arms.

15. The gripping device of claim 9, wherein the support is mounted by an axle on said winding machine, said axle cooperating with an oblong hole in a support chassis of the support, adjustable abutments being provided on the winding machine acting on said support to hold a corresponding lateral arm in a specific position.

* * * * *